US006874541B2

(12) United States Patent
Vossen

(10) Patent No.: US 6,874,541 B2
(45) Date of Patent: Apr. 5, 2005

(54) TEMPORARY DUCT COVER

(75) Inventor: Steve Vossen, Willmar, MN (US)

(73) Assignee: Ductcap Products, Inc., Willmar, MN (US)

( * ) Notice: Subject to any disclaimer, the term of this patent is extended or adjusted under 35 U.S.C. 154(b) by 0 days.

(21) Appl. No.: 10/437,566

(22) Filed: May 14, 2003

(65) Prior Publication Data

US 2003/0220071 A1 Nov. 27, 2003

Related U.S. Application Data

(60) Provisional application No. 60/381,466, filed on May 17, 2002.

(51) Int. Cl.[7] ..... F16L 57/00

(52) U.S. Cl. ..... 138/96 R; 138/89.4; 150/154; 454/370

(58) Field of Search ..... 138/89.1, 89.2, 138/89.3, 89.4, 96 R, 96 T; 150/154; 454/18, 370

(56) References Cited

U.S. PATENT DOCUMENTS 2,942,625 A * 6/1960 Costanzo ..... 138/96 R
3,168,209 A * 2/1965 Brookins et al. ..... 150/154
4,168,726 A * 9/1979 Klennert ..... 138/96 R
5,687,773 A * 11/1997 Ryan et al. ..... 138/96 R
5,837,040 A * 11/1998 Caughron et al. ..... 96/224

* cited by examiner

*Primary Examiner*—Harold Joyce
(74) *Attorney, Agent, or Firm*—Patterson, Thuente, Skaar & Christensen, P.A.

(57) ABSTRACT

A duct cover for installation on a duct having a known sectional area defined by the duct exterior margin, includes a cover envelop having a body, the body having an open end and an opposed closed end with a center portion extending between the open end and the closed end to define an envelop enclosure, the body being substantially impermeable relative to airborne particulate and moisture, and an elastic member being operably coupled to the body open end and having a relaxed disposition and an expanded disposition, the expanded disposition defining an opening that is area that is greater than the duct sectional area, the elastic member being contractable from the expanded disposition to a duct conforming disposition in compressive sealing engagement with the duct exterior margin. A method of installing a duct cover on a duct is further included.

11 Claims, 3 Drawing Sheets

10
12
14
16
18
20
24
28
40
16"
20"
24"

TEMPORARY DUCT COVER

RELATED APPLICATION

The present application claims the benefit of U.S. Provisional Application, Ser. No. 60/381,466, filed May 17, 2002, and incorporated herein in its entirety by reference.

FIELD OF THE INVENTION

The present invention relates generally to duct covers. More specifically, the present invention is a duct cover that is adapted for use during construction of a structure having ductwork installed therein when a duct may otherwise be left uncovered.

BACKGROUND OF THE INVENTION

Air handling units and controls for heating, ventilation and air conditioning (HVAC) are expensive and sensitive to outside contaminants. The outside contaminants can produce health problems, such as allergies and other illnesses (see EPA article, EPA-402-K-97-002, October 1997, "Should You Have Your Ducts Cleaned" at page 2), and can erode warranties on the HVAC system. To avoid health problems and maintain system warranties, it is imperative that contaminants such as dirt, dust, moisture and other debris are kept out of the HVAC system.

This is often a difficult task, as the HVAC systems are usually hung during building construction. The ductwork is hung after the building is framed, but not yet completed. The ductwork is usually hung long before the HVAC unit itself is installed. This delay results in a great need for temporary duct covers. HVAC units are commonly roof-mounted. The units mount on a curb that has a supply and a return opening. This curb is placed in a hole cut in the roof. The curb openings are shaped to fit the HVAC unit. Until the unit is fitted to the curb, the openings are left uncovered. To keep debris from the roof installation, rain or any other contaminants out of the HVAC system, poly plastic sheeting is placed on the curb openings and secured with duct tape. Poly plastic is also commonly duct taped around duct openings in the interior of buildings. This process is cumbersome, time-consuming and often requires two people.

SUMMARY OF THE INVENTION

The present invention solves the problems inherent to the current method of covering ducts. The invention is a duct cover made of a suitable waterproof material having an elastic structure such that the cover conforms to the shape of the duct it is placed on. The elastic structure allows the cover to conform to a round, square, rectangular or other shaped duct. Further, the elastic structure eliminates the cumbersome process of taping plastic to the ducts.

The present invention is a duct cover for installation on a duct having a known sectional area defined by the duct exterior margin and includes a cover envelop having a body, the body having an open end and an opposed closed end with a center portion extending between the open end and the closed end to define an envelop enclosure, the body being substantially impermeable relative to airborne particulate and moisture, and an elastic member being operably coupled to the body open end and having a relaxed disposition and an expanded disposition, the expanded disposition defining an opening that is area that is greater than the duct sectional area, the elastic member being contractable from the expanded disposition to a duct conforming disposition in compressive sealing engagement with the duct exterior margin. The present invention is further a method of installing a duct cover on a duct.

DETAILED DESCRIPTION OF THE PREFERRED EMBODIMENTS

Figure 1:
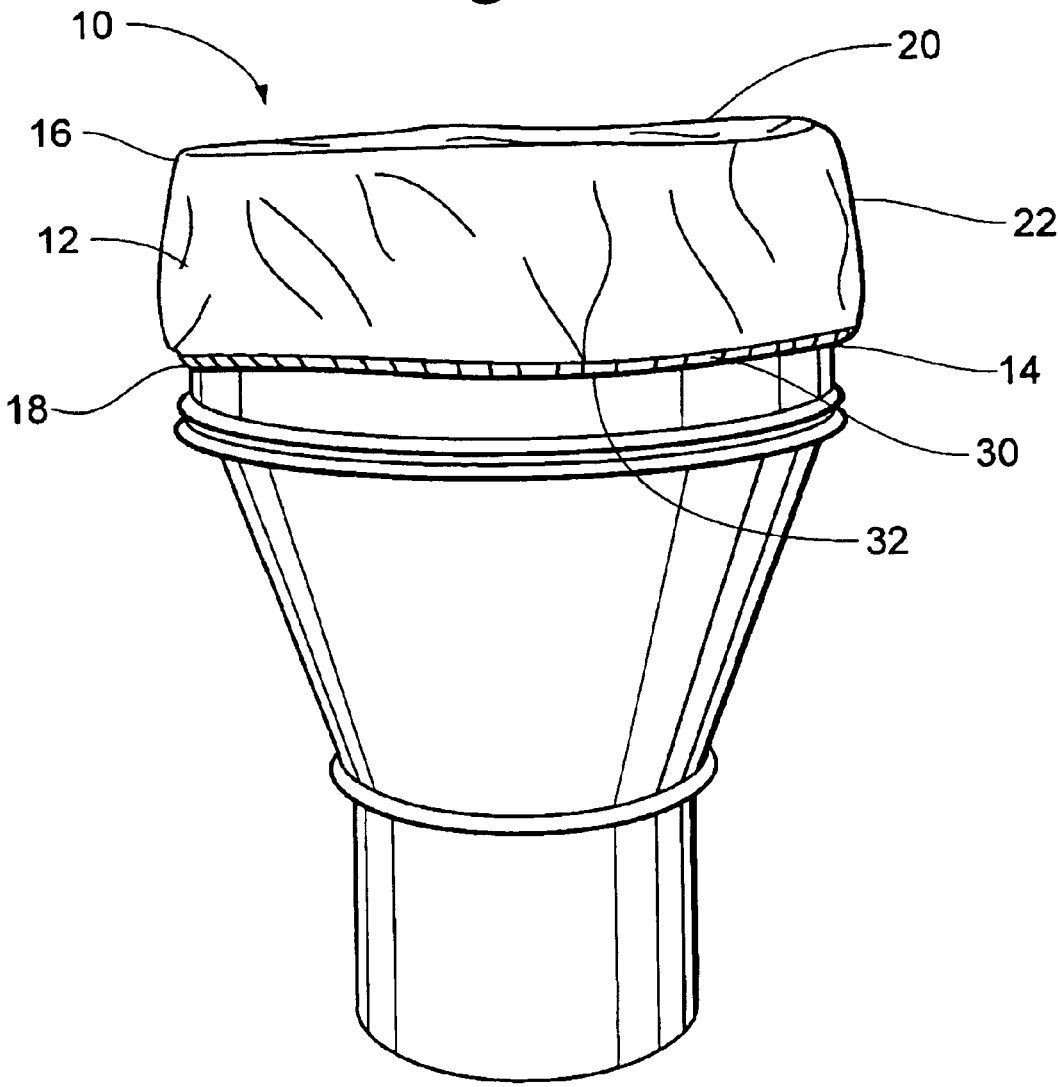
FIG. 1 is a perspective view of a cover of the present invention disposed on a section of duct.
Figure 2:
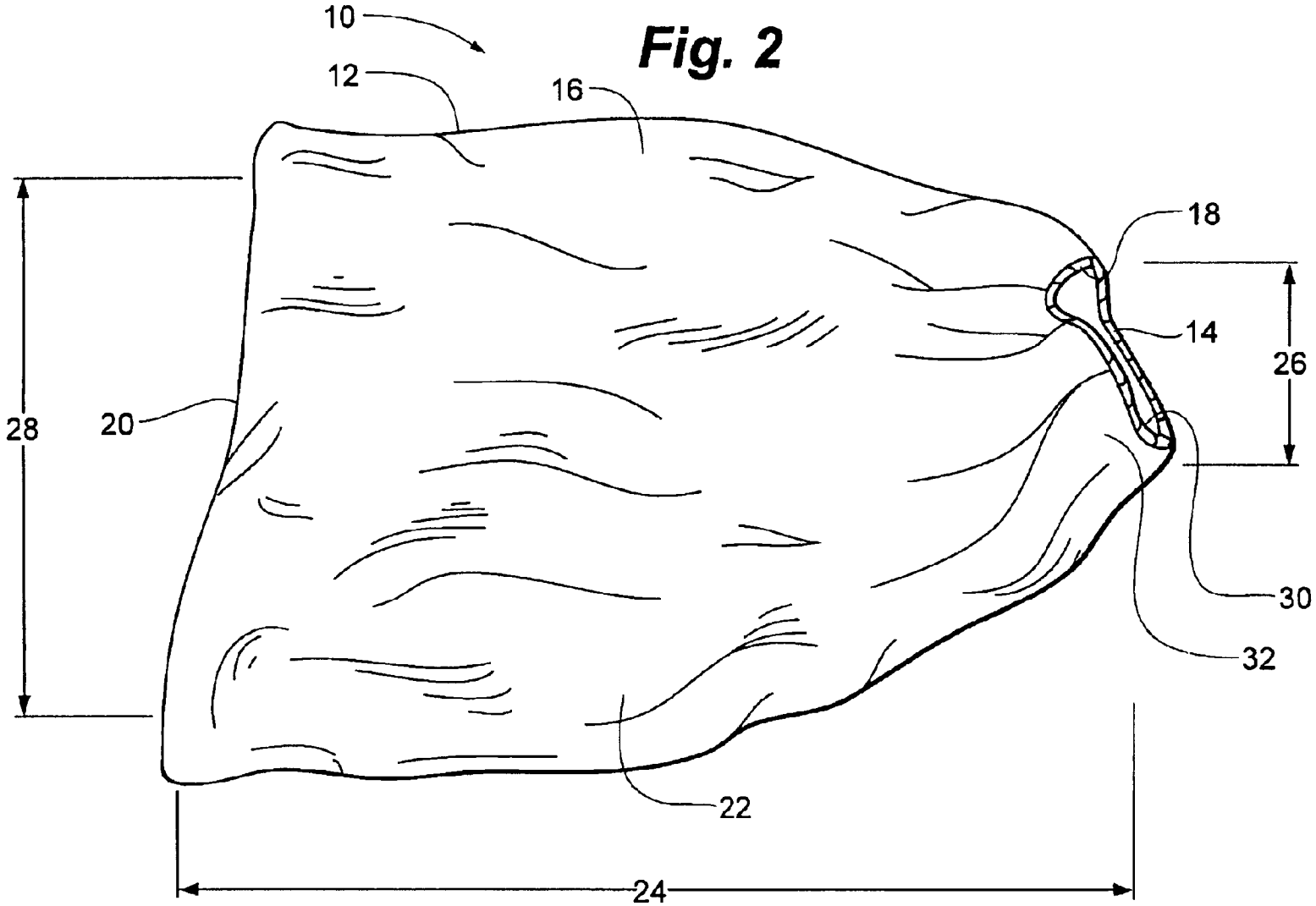
FIG. 2 is a perspective view of another embodiment of a cover of the present invention.

The present invention is a duct cover made of a suitable airborne particle-proof and waterproof material having an elastic structure such that the cover conforms to the shape of the duct it is placed on. The cover has many other advantages. The cover may be made in different sizes: a small cover for 4 to 8 inch ducts (see FIGS. 3A and 3B), a medium for 10 to 14 inch ducts (see FIGS. 4A and 4B), and a large for 16 to 20 inch ducts or larger. The suitable waterproof material, such as poly plastic, may be made of different thickness. The duct cover may thus be reusable or disposable, depending on the thickness of suitable waterproof material used. The thickness of suitable waterproof material may vary from 1–20 mil. The strength and width of the elastic member may also vary as needed.

The temporary duct cover of the present invention is shown generally at 10 in the figures. Cover 10 has two major subassemblies: envelope 12 and elastic member 14.

The envelope 12 has a body 16. The body 16 has an open end 18 and an opposed closed end 20. A generally tubular shaped center portion 22 extends between the open end 18 and the closed end 20. The body 16 is preferably formed of a poly plastic material. Light transmissivity of the body 16 is not typically an important feature and accordingly, the body 16 may be clear or opaque as desired.

The body 16 has a length dimension 24 measured from the open end 18 to the closed end 20. The open end 18 has a diameter 26 when the open end 18 is formed in a generally circular shape. Preferably, the length dimension 24 is between one and five times the diameter 26. The generally tubular shape center portion 22 has a diameter 28. The sectional area of the generally tubular shape center portion 22 is preferably significantly greater than an area defined by a sectional exterior margin of the duct 40 on which the temporary duct cover 10 is to be installed.

The elastic member 14 has a closed shape 30. The closed shape 30 may be effected by forming the elastic member 14 in a closed loop or by forming the elastic member 14 in an elongate ribbon and joining the two ends thereof together.

The elastic member 14 is secured to the open end 18 of the body 16 in a suitable manner, such as by bonding or stitching. When the elastic member 14 is secured to the open end 18, a plurality of gathers 32 are formed at the open end 18. In its relaxed state, the elastic member 14 typically forms an opening having an area significantly less than the area of the generally tubular shaped center portion 22 of the body 16, resulting in the formation of the gathers 32. The elastic member 14 preferably has a stretched opening area. It is somewhat greater than the sectional exterior margin area of a duct 40 on which the temporary duct cover 10 is intended to be installed. The elastic member 14 has sufficient resilience and flexibility to tightly conform to the exterior margin of the duct 40 on which the temporary duct cover 10 is installed when the elastic member 14 is released from its expanded area and permitted to contract about the exterior margin of the duct 40 in a duct confirming disposition.

In operation, a user stretches open the elastic member 14 to an area exceeding the sectional area of the exterior margin of the duct 40 on which the temporary duct cover 10 is to be installed. The temporary duct cover 10 is then slid over the duct 40 until the closed end 20 is generally snug on the duct 40 opening. The elastic member 14 is then released and the elastic member 14 conforms to the duct 40 exterior margin in compressive, sealing engagement. The temporary duct cover 10 is typically slid on to the duct 40 for a length that is substantially equal to the length dimension 24 of the body 16. This places the open end 18 of the body 16 well away from the open end of the duct 40. Such placement facilitates keeping the temporary duct cover 10 in sealing engagement with the duct 40 even should the duct 40 have a slight over pressure with respect to ambient conditions. Such over pressure tends to cause a temporary duct cover 10 having a lesser length dimension 24 to be slowly displaced from the duct 40.

Figures 3A, 3B, 4A, 4B:
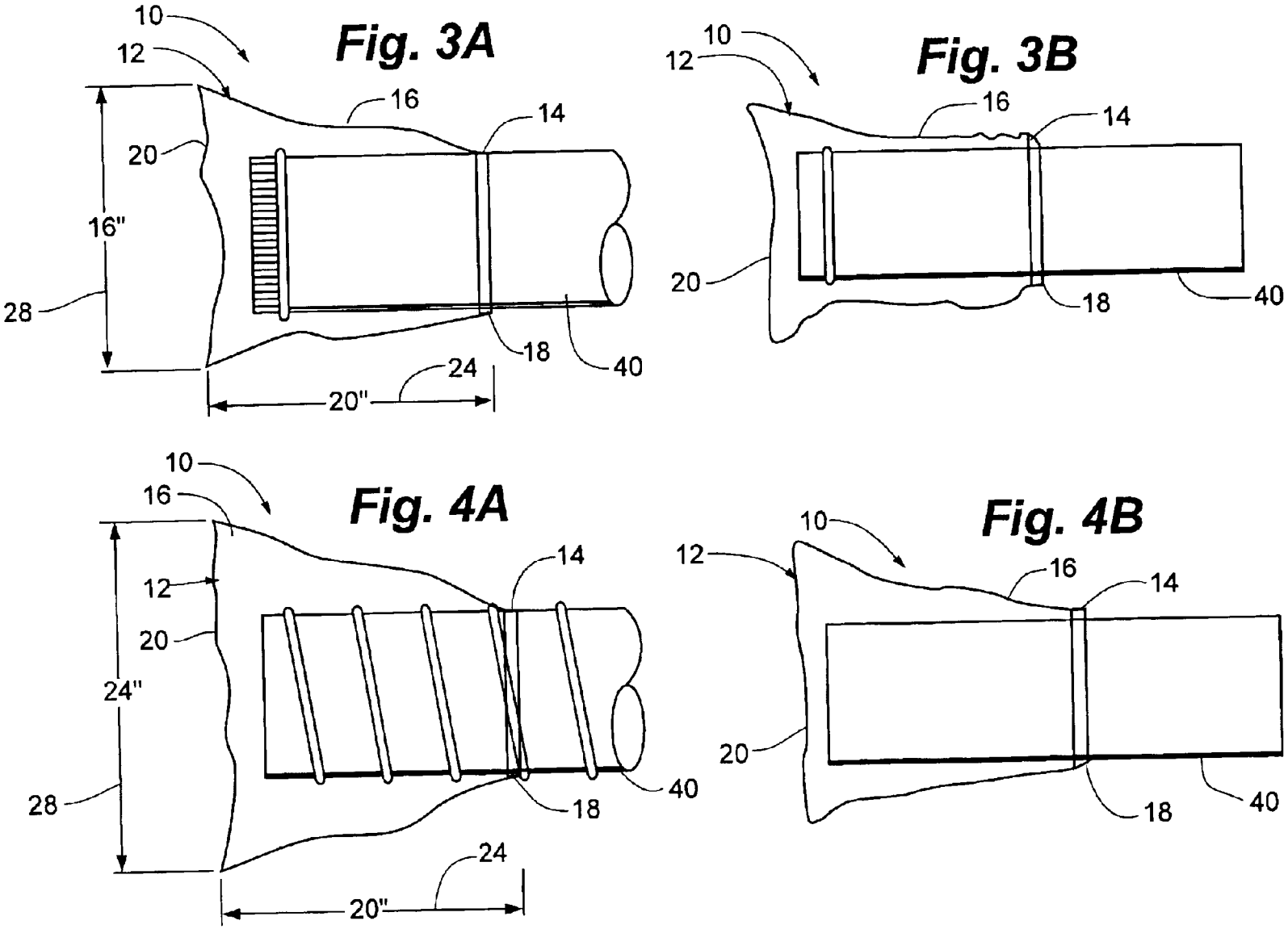
FIG. 3A is a perspective view of a cover of the present invention disposed on a section of relatively smaller duct.
FIG. 3B is a photographic perspective view of the cover of FIG. 3A.
FIG. 4A is a perspective view of a cover of the present invention disposed on a section of relatively larger duct.
FIG. 4B is a photographic perspective view of the cover of FIG. 4A.

FIGS. 3A and 3B depict a temporary duct cover 10 having a size suitable for emplacement on a duct 40 having a diameter of 6 inches to 10 inches. FIGS. 4A and 4B depict a temporary duct cover 10 having a size suitable for emplacement on a duct 40 having a diameter of 10 inches to 14 inches.

It is contemplated that features disclosed in this application, as well as those described in the above application incorporated by reference, can be mixed and matched to suit particular circumstances. Various other modifications and changes will be apparent to those of ordinary skill.

What is claimed is:

1. A duct cover for installation on a duct having a known sectional area defined by the duct exterior margin, comprising:

a cover envelop having a flexible body, the body having a substantially amorphous shape formed of a unitary, integral sheet, including an open end and an opposed closed end with a center portion extending between the open end and the closed end to define an envelop enclosure, the body being substantially impermeable relative to airborne particulate and moisture; and an elastic member being operably coupled to the body open end and having a relaxed disposition and an expanded disposition, the expanded disposition defining an opening that is area that is greater than the duct sectional area, the elastic member being contractable from the expanded disposition to a duct conforming disposition in compressive sealing engagement with the duct exterior margin.

2. The duct cover of claim 1, the body having a length dimension measured from the open end to the closed end and the open end having a diameter when the open end is disposed in a substantially circular disposition, the length dimension being substantially greater than the diameter.

3. The duct cover of claim 2, the body length dimension being between one and five times the diameter.

4. The duct cover of claim 1, the body center portion defining an interior area, the interior area being greater than the known sectional area defined by the duct exterior margin.

5. The duct cover of claim 1, the cover envelop being formed of a flexible poly plastic material.

6. A method of installing a duct cover for on a duct having an opening and a known sectional area defined by the duct exterior margin, comprising:

stretching a closed elastic member to define an interior area that is greater than the known sectional area defined by the duct exterior margin;

forming a duct cover body of a unitary, integral flexible sheet of material having a substantially amorphous shape;

sliding the duct cover over the duct opening and the duct exterior margin; and releasing the closed elastic member to contract into a conforming, sealing, compressive engagement with the duct exterior margin.

7. The method of claim 6, including forming a cover envelop having a body, the body having an open end and an opposed closed end with a center portion extending between the open end and the closed end to define an envelop enclosure and forming the body substantially impermeable relative to airborne particulate and moisture; and operably coupling an elastic member to the body open end, the elastic member having a relaxed disposition and an expanded disposition, defining an opening that is area that is greater than the duct sectional area when in the expanded disposition, and defining a duct conforming disposition in compressive sealing engagement with the duct exterior margin when the elastic member is contracted from the expanded disposition.

8. The method of claim 7, the body having a length dimension measured from the open end to the closed end and the open end having a diameter when the open end is disposed in a substantially circular disposition, the length dimension being substantially greater than the diameter.

9. The method of claim 8, including forming the body length dimension being between one and five times the diameter.

10. The method of claim 6, including defining a body center portion interior area, the interior area, the interior area being greater than the known sectional area defined by the duct exterior margin.

11. The method of claim 6, including forming the cover envelop of a flexible poly plastic material.

* * * * *